US005964098A

United States Patent [19]

Huang et al.

[11] Patent Number: 5,964,098

[45] Date of Patent: Oct. 12, 1999

[54] AUXILIARY CONDENSER FOR AIR CONDITIONERS

[75] Inventors: Chin-Hsien Huang, Hsinchu Hsien; Peng-Chu Chiu, Hsinchu; Allen Liu, Taichung Hsien, all of Taiwan

[73] Assignee: Nutec Electrical Engineering Co., Ltd., Taipei, Taiwan

[21] Appl. No.: 09/140,770

[22] Filed: Aug. 26, 1998

[30] Foreign Application Priority Data

May 8, 1998 [TW] Taiwan ..... 87207185

[51] Int. Cl.[6] ..... F25B 40/02

[52] U.S. Cl. ..... 62/279; 62/506; 62/507

[58] Field of Search ..... 62/506, 507

[56] References Cited

U.S. PATENT DOCUMENTS 5,660,050 8/1997 Wilson et al. ..... 62/125
5,666,813 9/1997 Brune ..... 62/90

*Primary Examiner*—Henry Bennett
*Assistant Examiner*—Mark Shulman
*Attorney, Agent, or Firm*—Rosenberg, Klein & Bilker

[57] ABSTRACT

An auxiliary condenser includes a plurality of heat conductive tubes connected in series between a compressor and a main condenser of an air conditioning system to absorb heat energy of compressed, hot, gas state coolant outputted from the compressor, absorptive covering means covered on the heat conductive tube to absorb condensed water from evaporator means of the air conditioning system for carrying heat away from the heat conductive tubes by means of evaporation.

3 Claims, 8 Drawing Sheets

AUXILIARY CONDENSER FOR AIR CONDITIONERS

BACKGROUND OF THE INVENTION

The present invention relates to an auxiliary condenser for use in an air conditioning system to receive heat from compressed, hot, gas state coolant outputted from the compressor of the air conditioning system and to absorb condensed water from the evaporator of the air conditioning system, and then to dissipate received heat by means of evaporation.

When an air conditioning system is operated, condensed water is produced from the evaporator. In order to prevent the accumulation of condensed water, a guide tube must be installed to guide condensed water out of the housing of the main unit of the air conditioning system. However, the guide tube tends to be blocked by dirt, causing condensed water to be accumulated in the main unit.

SUMMARY OF THE INVENTION

The present invention eliminates the aforesaid problem. It is one object of the present invention to provide an auxiliary condenser for an air conditioning system which eliminates the accumulation of condensed water, and keeps the inside of the main unit of the air conditioning system dry. It is another object of the present invention to provide an auxiliary condenser for an air conditioning system which greatly improves the circulation efficiency of the coolant (Freon). According to one aspect of the present invention, the auxiliary condenser comprises a plurality of heat conductive tubes connected in series between a compressor and a main condenser of an air conditioning system to absorb heat energy of compressed, hot, gas state coolant outputted from the compressor, absorptive covering means covered on the heat conductive tube to absorb condensed water from evaporator means of the air conditioning system for carrying heat away from the heat conductive tubes by means of evaporation. According to another aspect of the present invention, shield means is covered on the absorptive covering means to hold the heat conductive tubes in place.

DETAILED DESCRIPTION OF THE PREFERRED EMBODIMENT

Figure 1:
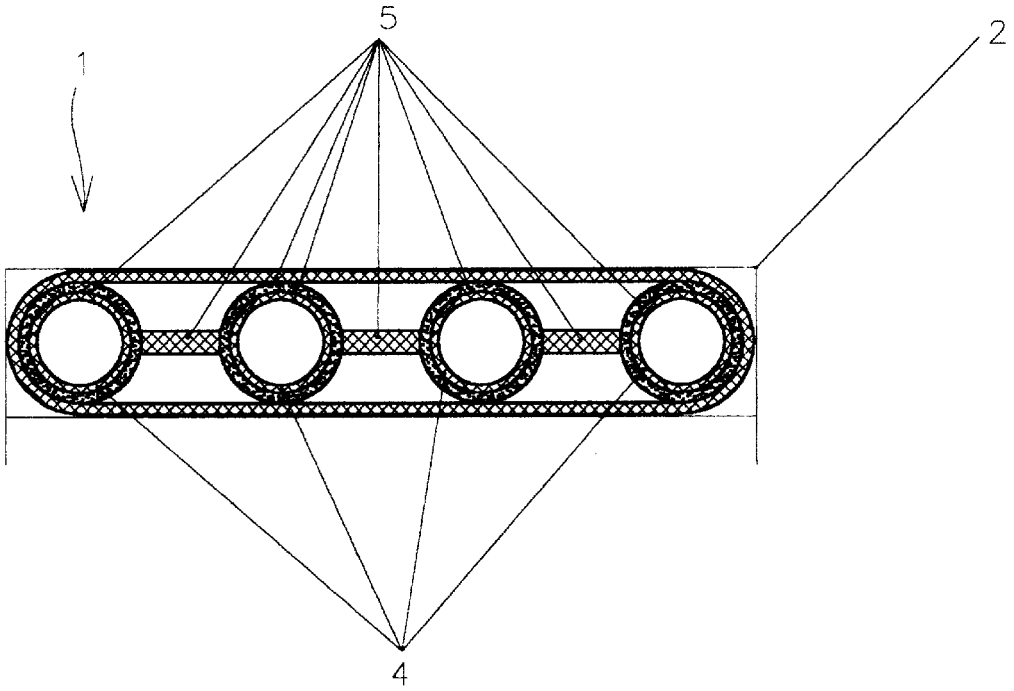
FIG. 1 is a cross sectional view of an auxiliary condenser according to the present invention.
Figure 2:
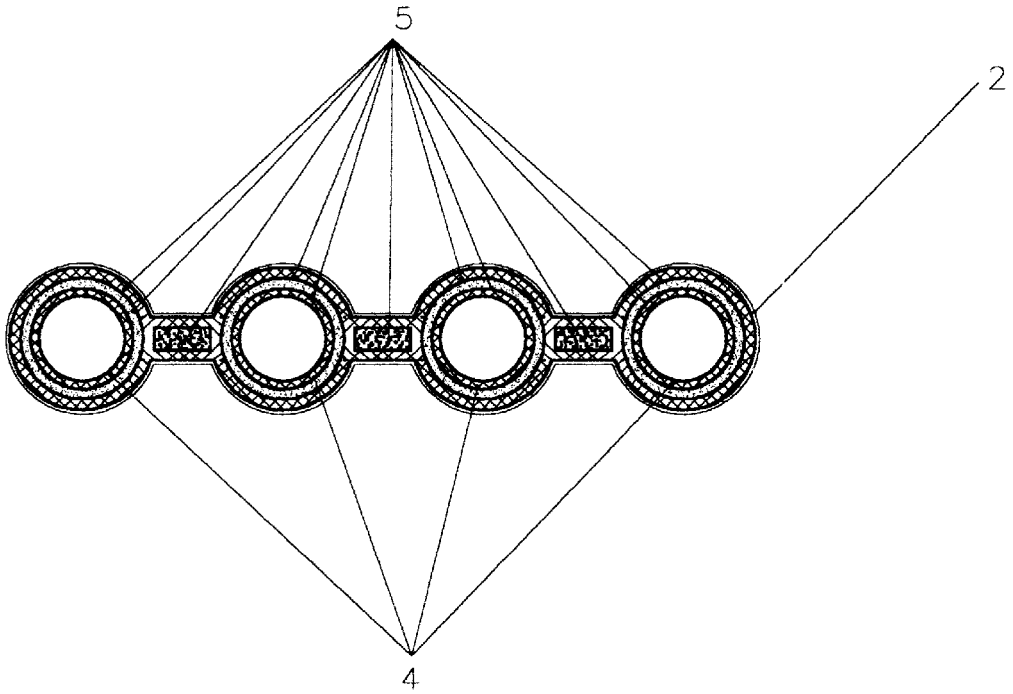
FIG. 2 is a cross sectional view of an alternate form of the present invention

Referring to FIGS. 1 and 2, an auxiliary condenser 1 in accordance with the present invention comprises a plurality of heat conductive tubes 4 connected together to receive heat energy of compressed, hot, gas state coolant (Freon) outputted from the compressor of an air conditioning system, and absorptive material 5 covered on the heat conductive tubes 4 to absorb condensed water from the evaporator of the air conditioning system. When absorbed water is evaporated from the absorptive material 5, heat is simultaneously carried away from the heat conductive tubes 4.

Figure 3:
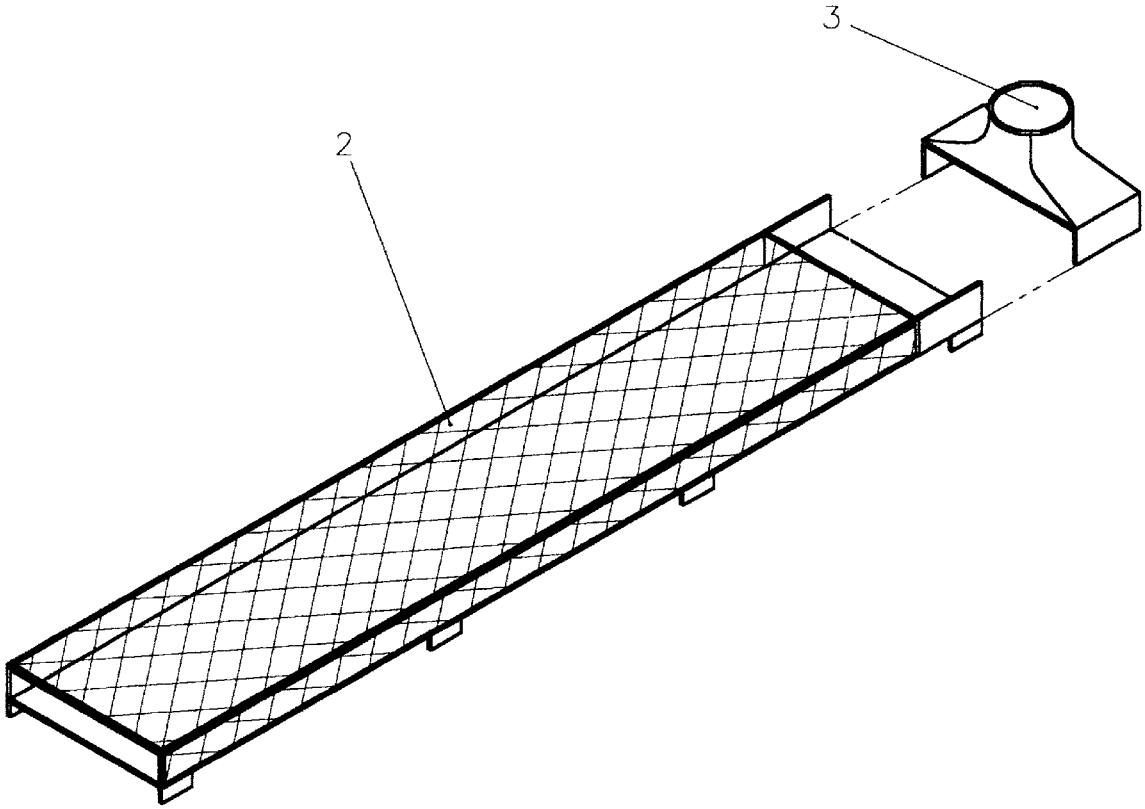
FIG. 3 is a perspective view of a shield for the auxiliary condenser according to the present invention.

Referring to FIG. 3 and FIGS. 1 and 2 again, a shield 2 is provided to hold the absorptive material 5 covered heat conductive tubes 4 on the inside. The shield 2 has a water inlet 3 at one end for guiding in condensed water from the evaporator.

Figure 4:
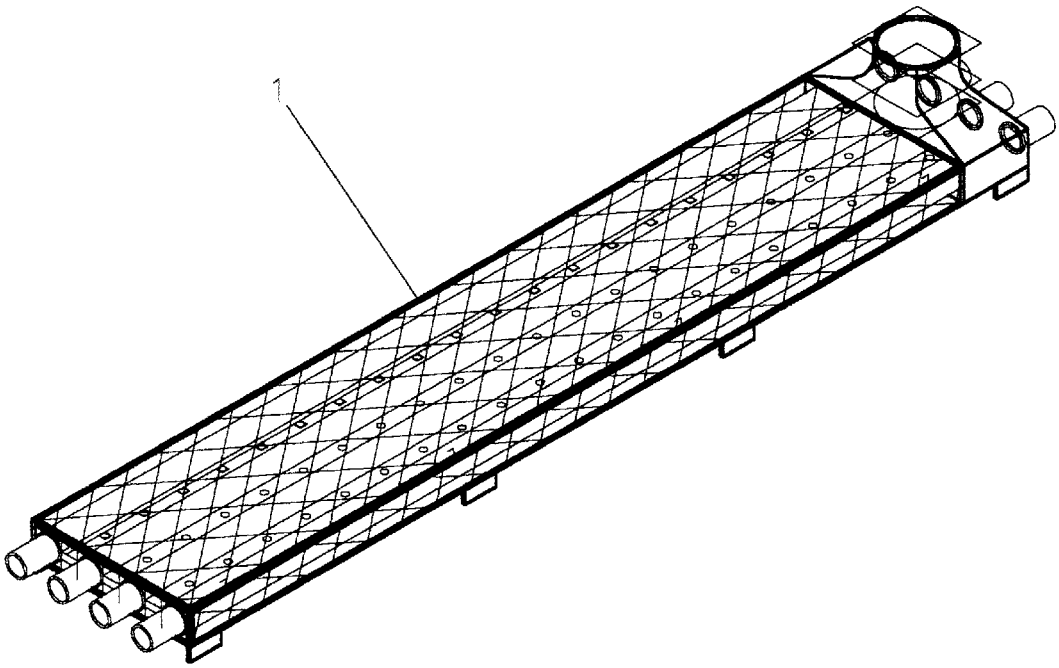
FIG. 4 is a perspective view of an auxiliary condenser according to one embodiment of the present invention.
Figure 5:
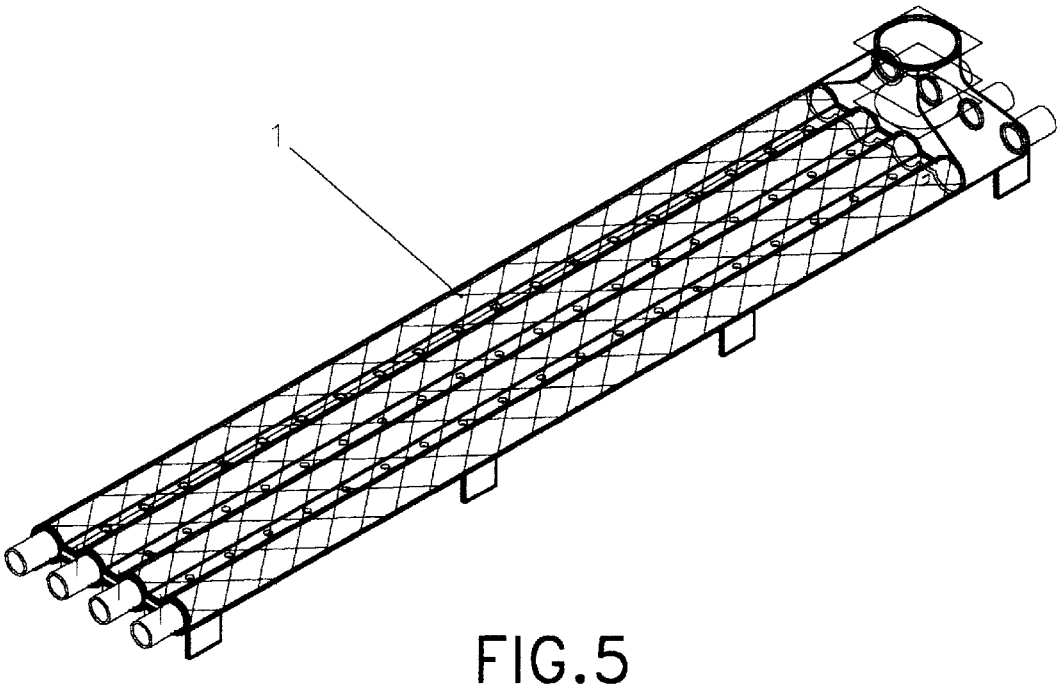
FIG. 5 is a perspective view of an auxiliary condenser according to another embodiment of the present invention.

Referring to FIGS. 4 and 5, the size and number of the heat conductive tubes 4 of the auxiliary condenser 1 as well as the shape of the shield 2 can be variously designed.

Figure 6:
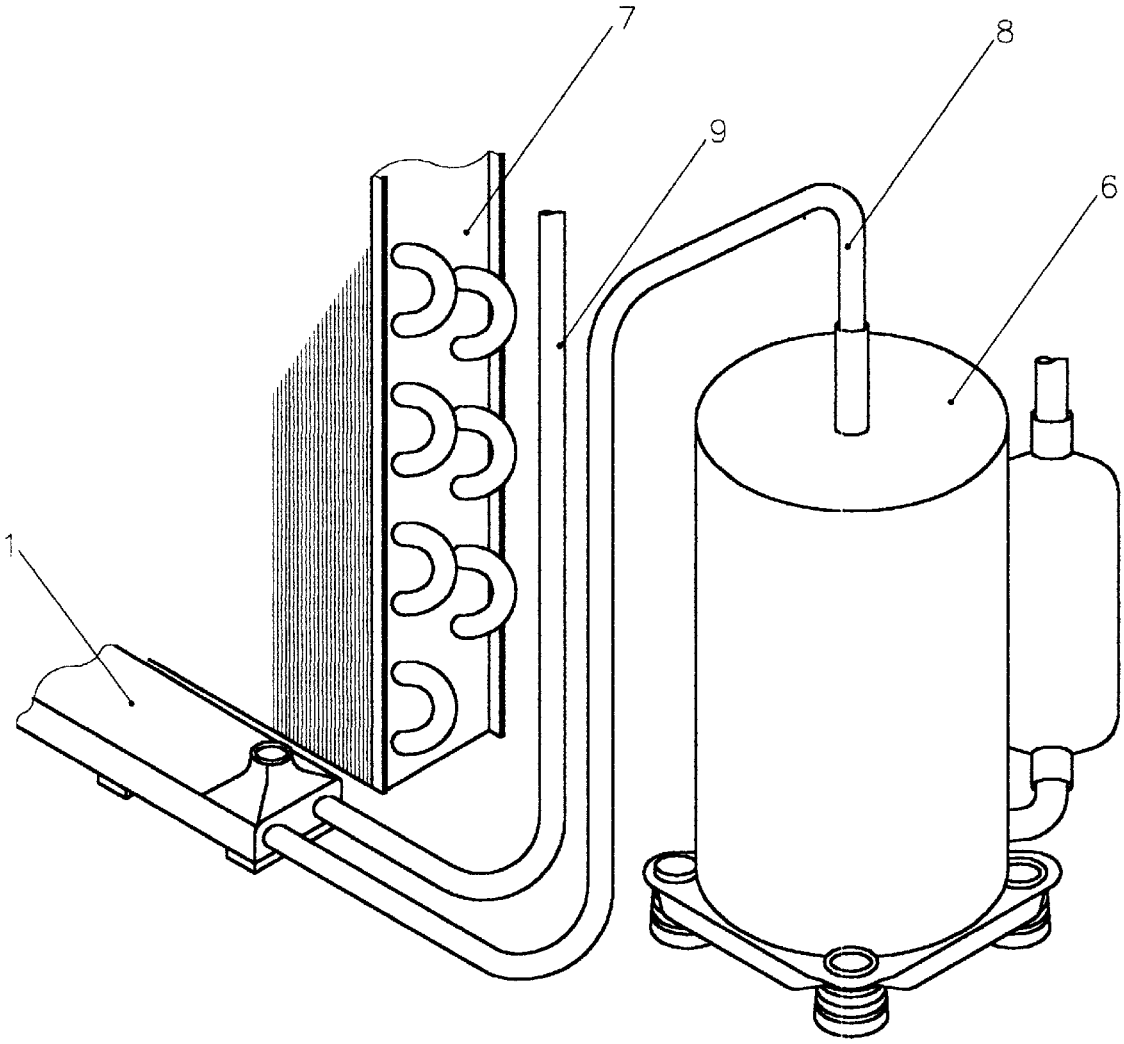
FIG. 6 shows an auxiliary condenser connected in series between a compressor and a main condenser and arranged in a horizontal position according to the present invention.

Referring to FIG. 6, compressed, hot, gas state coolant (Freon) is outputted from the compressor 6 of the air conditioning system and guided into the auxiliary condenser 1 by an inlet pipe 8, and then guided out of the auxiliary condenser 1 to the main condenser 7 of the air conditioning system by an outlet pipe 9, i.e., the auxiliary condenser 1 is connected in series between the compressor 6 and the main condenser 7 of the air conditioning system. Therefore, the auxiliary condenser 1 improves the circulation efficiency of the coolant (Freon).

Figure 7:
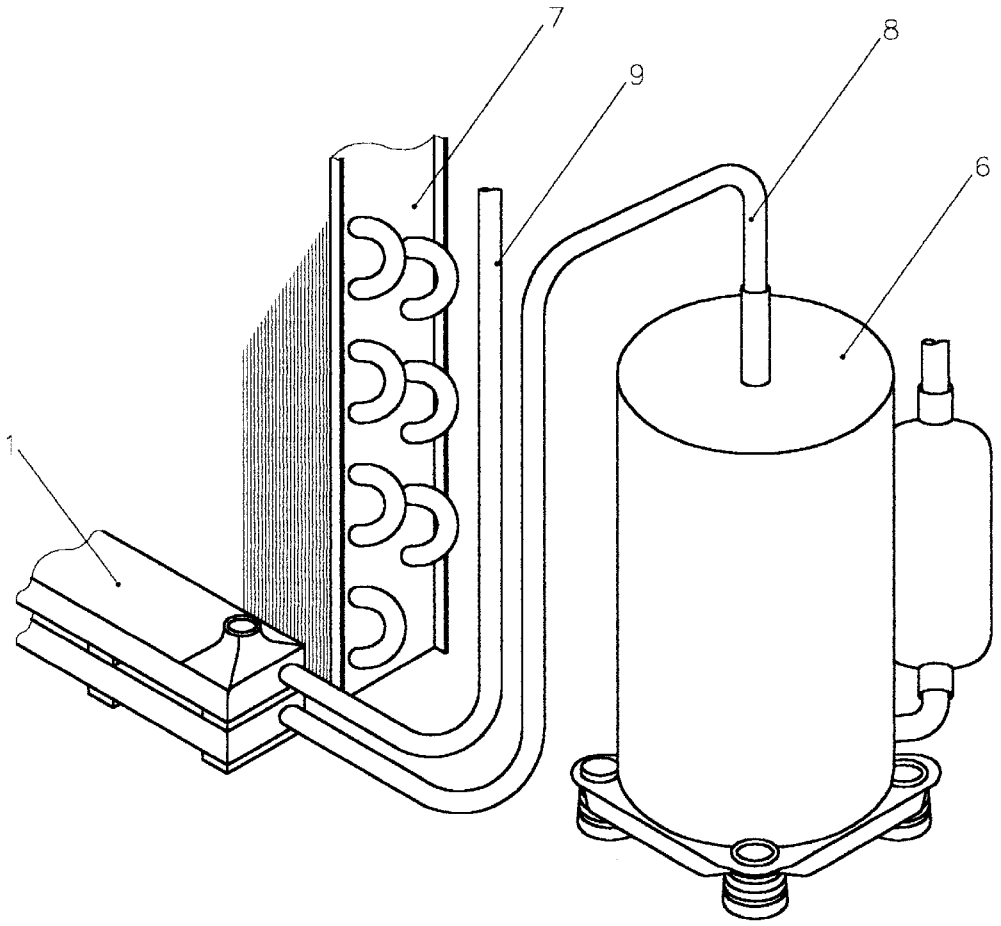
FIG. 7 shows two auxiliary condenser horizontally arranged in a stack and connected in series between a compressor and a main condenser according to the present invention.

Referring to FIG. 7, a plurality of auxiliary condensers 1 may be arranged in a stack and connected in series between the compressor 6 and the main condenser 7 of the air conditioning system.

Figure 8:
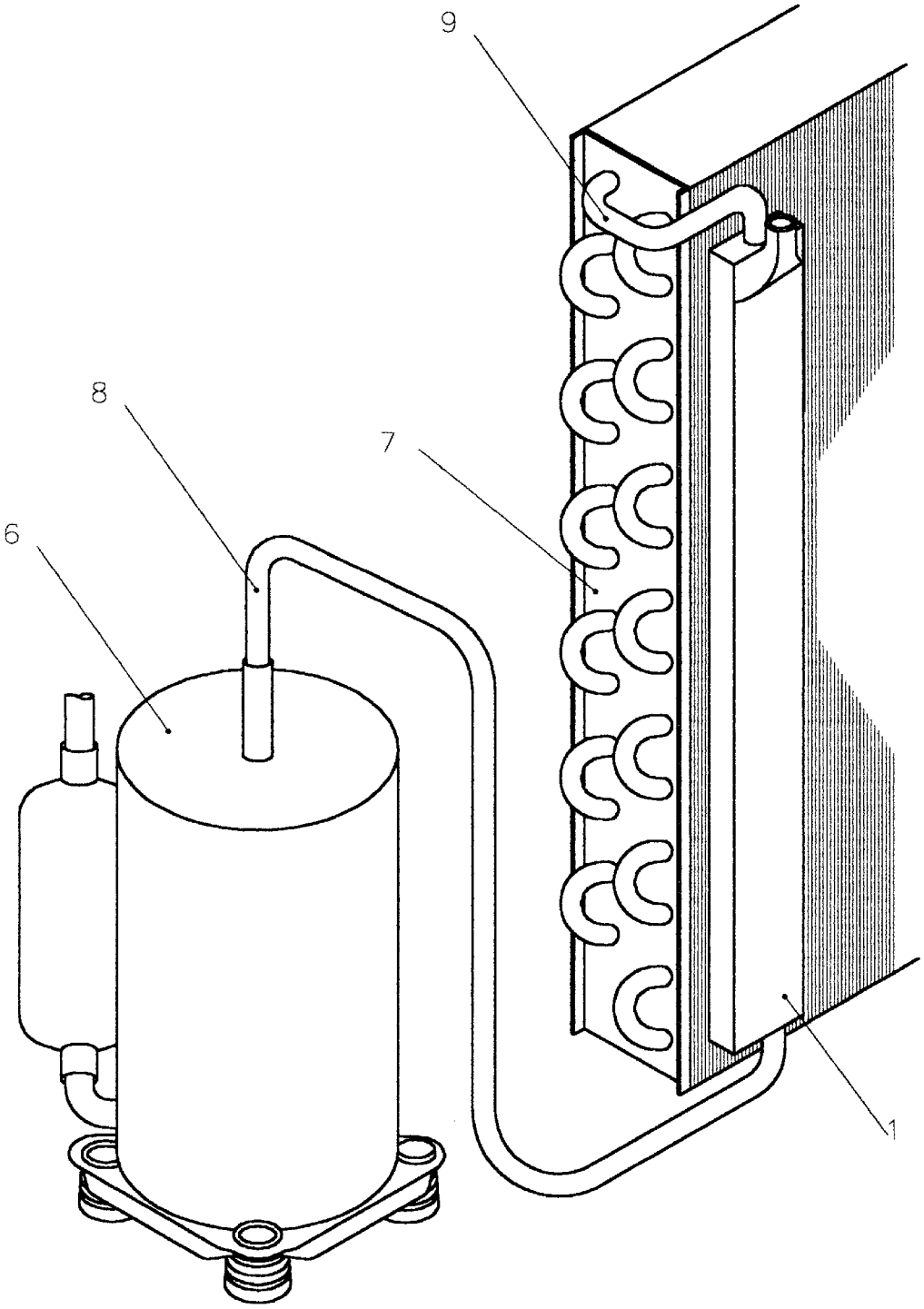
FIG. 8 shows an auxiliary condenser connected in series between a compressor and a main condenser and arranged in a vertical position according to the present invention.
Figure 9:
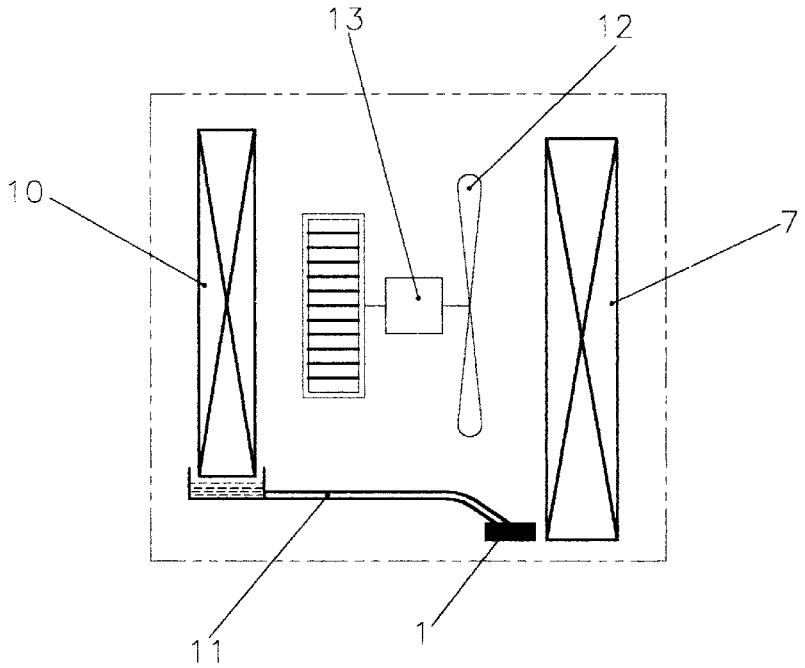
FIG. 9 is an applied view of the present invention.
Figure 10:
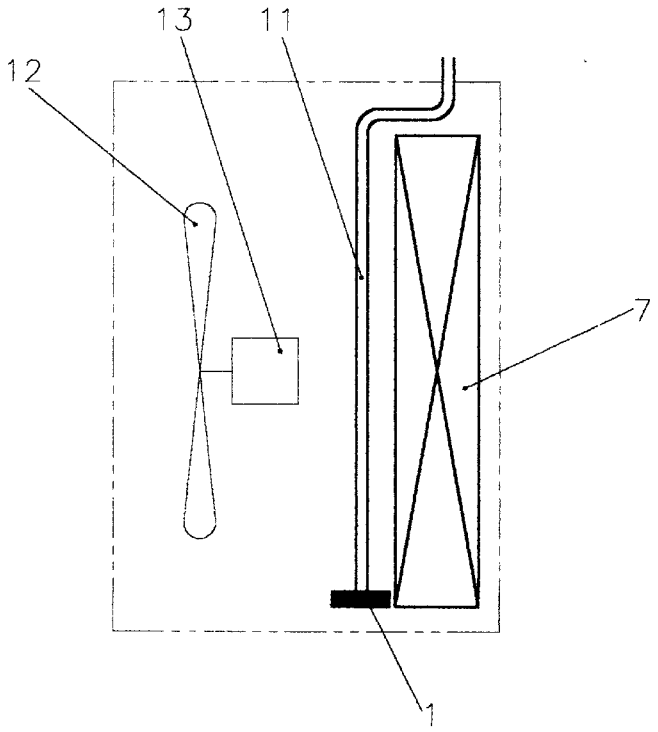
FIG. 10 is another applied view of the present invention.
Figure 11:
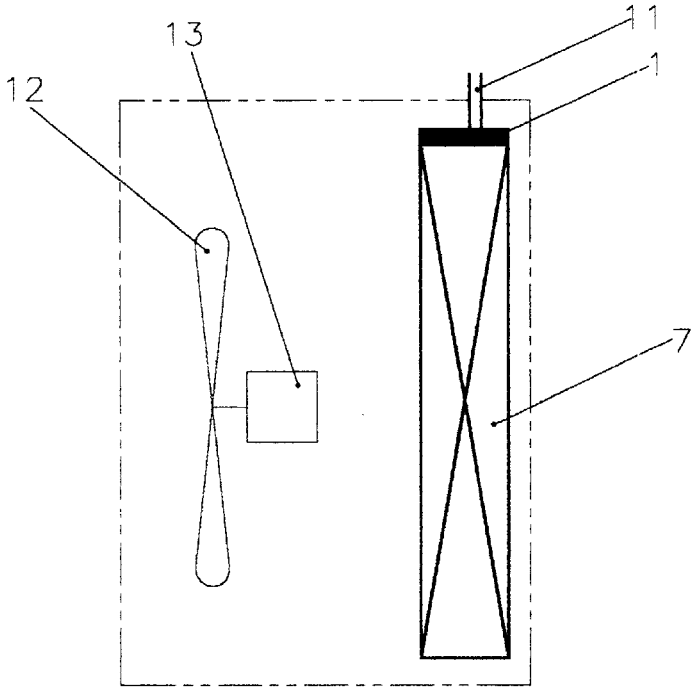
FIG. 11 is still another applied view of the present invention.
Figure 12:
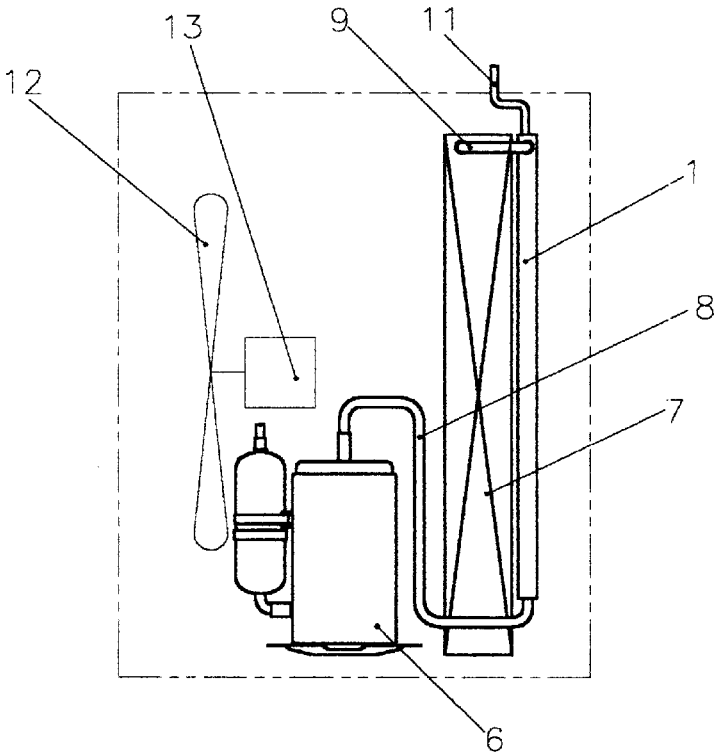
FIG. 12 is still another applied view of the present invention.

Referring to FIG. 8, the auxiliary condenser 1 can be arranged in a vertical position and connected in series between the compressor 6 and the main condenser 7 of the air conditioning system.

Referring to Figures from 9 to 12 and FIG. 1 again, condensed water is collected from the evaporator 10 of the air conditioning system and guided to the absorptive material 5 of the auxiliary condenser 1 by a water pipe 11 for heat exchange through evaporation, and a fan 12 is driven by a fan motor 13 to cause currents of air, enabling hot air to be quickly carried away from the condensers 1;7.

It is to be understood that the drawings are designed for purposes of illustration only, and are not intended as a definition of the limits and scope of the invention disclosed.

What the invention claimed is:

1. An air conditioning system comprising:

a compressor for compressing a refrigerant gas;

condensing means having an inlet coupled to an outlet of said compressor for changing said refrigerant gas to a refrigerant liquid; and, an evaporator having an inlet coupled to an outlet of said condensing means and an outlet coupled to an inlet of said compressor for returning said refrigerant gas to said compressor and condensing moisture from air passed thereby, said evaporator including means for coupling the condensate to a water inlet of said condensing means, said condensing means including an auxiliary condenser coupled in series with a main condenser, said auxiliary condenser having a refrigerant inlet coupled to said outlet of said compressor and a refrigerant outlet coupled to a refrigerant inlet of said main condenser, said main condenser having a refrigerant outlet coupled to said inlet of said evaporator, said auxiliary condenser including a plurality of heat conductive tubes coupled in fluid communication between said refrigerant inlet and outlet of said auxiliary condenser, each of said heat conductive tubes being covered by a moisture absorptive material, said water inlet being formed in said auxiliary condenser to supply water to said absorptive material.

2. The air conditioning system as recited in claim 1 further comprising a shield covering said absorptive material and holding said plurality of heat conductive tubes in place.

3. The air conditioning system as recited in claim 2 where said water inlet is formed in said shield.

* * * * *